United States Patent [19]

Rekow

[11] 3,952,229

[45] Apr. 20, 1976

[54] DISPLAY DEVICE HAVING SIGNAL LAMPS

[75] Inventor: Heinz-Peter Rekow, Erlangen, Germany

[73] Assignee: Siemens Aktiengesellschaft, Munich, Germany

[22] Filed: Oct. 29, 1974

[21] Appl. No.: 518,981

[30] Foreign Application Priority Data

Oct. 31, 1973 Germany ..... 2354582

[52] U.S. Cl. ..... 315/131; 315/135; 324/21; 340/251

[51] Int. Cl.[2] ..... G08B 21/00

[58] Field of Search ..... 315/130, 131, 132, 133, 315/134, 135, 136; 324/21; 340/251

[56] References Cited

UNITED STATES PATENTS

| | | | |
|---|---|---|---|
| 3,631,393 | 12/1971 | Bennett | 340/251 |
| 3,643,247 | 2/1972 | Ratcliffe | 315/135 |
| 3,706,983 | 12/1972 | Olsen et al. | 340/251 |
| 3,719,937 | 3/1973 | Doyle | 340/251 |
| 3,745,547 | 7/1973 | Hadank | 340/251 |
| 3,825,914 | 7/1974 | Schacket | 340/251 |

*Primary Examiner*—John Kominski
*Attorney, Agent, or Firm*—Kenyon & Kenyon Reilly Carr & Chapin

[57] ABSTRACT

In a display device having a plurality of signal lamps, each lamp is coupled to a signal contact through a first decoupling diode and a test voltage having a voltage lower than that of the signal voltage is coupled to each lamp by means of a series resistance and second diode to generate a current acting both to pre-heat the lamp and for use in indicating lamp failure with a further diode coupled to the second diode providing an input to testing means giving an indication of a lamp failure.

2 Claims, 1 Drawing Figure

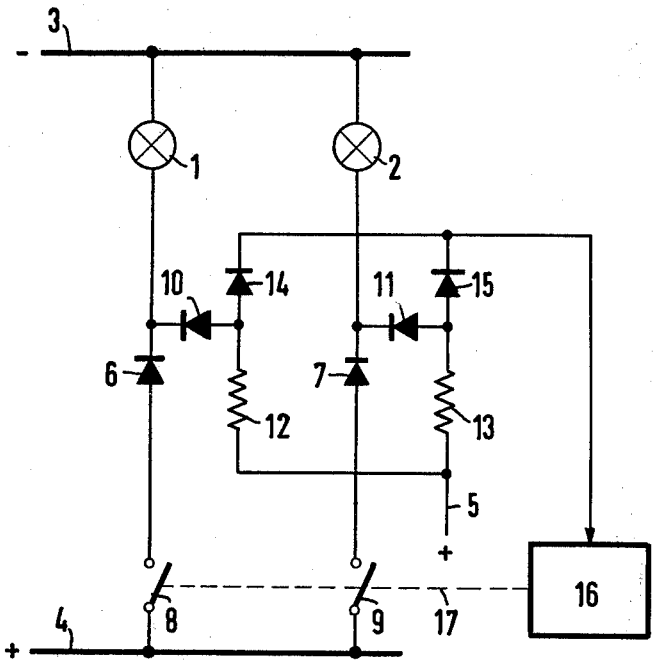
3
-
1
2
10
14
11
15
6
7
12
13
5
+
16
4
8
9
17
+

DISPLAY DEVICE HAVING SIGNAL LAMPS

The invention relates to a display device having signal lamps, whereby the signal lamps are connected to a signal voltage source through pilot contacts, and a test voltage source is provided to test the signal lamps.

The known display devices have separate test rails to test the signal lamps, all the signal lamps being connected to said rails. Said rails are periodically connected to voltage and lighting up of all the lamps is then observed by control personnel. In especially large display installations, particular difficulty is experienced by control personnel in identifying failure of a signal lamp among a multiplicity of signal lamps. Such display devices are also fitted with an acoustic warning device for signalling purposes. The acoustic warning device gives off a signal for each indication, whereas the fault is specifically indicated by the signal lamp. If a defect occurs in a signal lamp in the period between two tests, only a general acoustic signal ist given in the case of a fault in the relevant circuit. In such a case, the control personnel must then press the lamp test key to determine the fault specifically. Thus unnecessary time is lost for the respective necessary switching operations necessitated by the fault signal.

Moreover, prior art devices can have two signal lamps in parallel connection in every display field of the display device to indicate failure of an signal lamp. If one of the two signal lamps fail, the display field is illuminated in a correspondingly weaker manner and thus failure of an signal lamp ascertained. Such monitoring of the signal lamps is, however, unreliable, as perception of the various degrees of illumination in the individual display fields can be rendered difficult or uncertain by various conditions. Such unfavourable conditions can, for example, be varying light distribution in the room in which the display device is installed, or a large distance between the observer and the display device. Moreover, luminosity of the indicating lamps drop off with increasing age, and thus illumination of the respective display field weakens. Thus small differences as regards the degree of illumination of the individual display fields can result. Certain identification of signal lamp failure is made practically impossible by said differences.

It is an object of the invention to form a display device having signal lamps in such a manner that failure of a signal lamp is identified immediately and with certainly.

According to the invention each indicating lamp being in permanent connection with the testing voltage source via a respective series resistance decoupled from the signal voltage circuit, and the connection pole of the respective series resistance, connected with the respective indicating lamp, being connected to a testing device which emits a signal on failure of a lamp.

It is a further object of the invention to keep losses in the series resistances as small as possible, particulary if the test voltage is used to pre-warm the signal lamps. Therefore it is advantageous that the voltage of the test voltage source is lower than the voltage of the signal voltage source.

Monitoring of each individual indication lamp involves high expenditure in display devices having a very large number of display lamps. It is therefore advantageous in such display devices that the connection poles of a number of series resistances can be switched groupwise onto the testing device, and be decoupled from each other.

The indicating lamps in a display device e.g. a mosaic system diagram, in which a number of indicating lamps are always in operation may only be switched off, for a short period during testing procedures, so that transmission of information through the indicating lamps is not disturbed. This is realised in a simple manner by a computer being utilised as a testing device, the pilot contacts being controlled by said computer during testing operations.

The subject of the invention will be discribed in further detail with reference to an example of an embodiment shown in the drawing.

1 and 2 represent two signal lamps which are connected with their one connection pole to the common minus pole 3 of a signal and testing voltage source. 4 represents the plus pole of the signal voltage source and 5 the plus pole of the testing voltage source. The signal lamp 1 and 2 are connected with their other connection pole via a first decoupling diode 6 or 7 and a pilot contact 8 or 9 to the plus pole 4 of the signal voltage source. Moreover this other connection pole of the signal lamps 1 and 2 is connected via a second decoupling diode 10 or 11 and a series resistance 12 or 13 to the plus pole 5 of the testing voltage source. A third decoupling diode 14 or 15 is interposed between the second decoupling diode 10 or 11 and the series resistance 12 or 13. These third decoupling diodes 14 and 15 are mutually connected to a testing device 16. As represented by dashed, line 17, an effective connection exists between the testing device 16 and the signal contacts 8 and 9.

The indicating device works as follows: the signal lamps 1 and 2 can, as per FIGURE, be in fixed connection with the plus pole 5 of the testing voltage source. In this case the voltage of the testing voltage source is selected lower than the voltage of the signal voltage source. A current flows via the series resistances 12 and 13 and the second decoupling diodes 10 and 11 into the signal lamps 1 and 2, said current pre-warming the signal lamps. The potential at the common junction point of the series resistances 12 and 13 and of the second decoupling diodes 10 and 11 is tapped via the third decoupling diodes 14 and 15 and supplied to the testing device 16. As long as the signal lamps 1 and 2 are intact, the potential tapped at the common junction point of the series resistance and the respective second decoupling diode is lower than the potential of the plus pole 5 of the testing voltage source.

In the case of failure of one of the signal lamps 1 or 2, the potential at the common junction point of the series resistance 12 and the second decoupling diode 11 is equal to the potential of the plus pole 5 of the test voltage source. This higher potential reaches the testing device 16 via the third decoupling diode 14 or 15, thus actuating a signal.

If an effective connection exists between the testing device 16 and the pilot contact 8 and 9, these are automatically opened when a test command is given to the testing device 16. A particular advantage is gained by utilising a computer as a testing device 16, as a computer facilitates very low test times, and thus the transmission of information through the display device is not interrupted as a result of the short-term switching of all signal lamps.

The signal lamps of the display device described can be individually examined on principle. This, however, involves high expenditure. This expenditure can be reduced by arranging a given number of signal lamps into groups. The test circuits must be decoupled from each other when a number of signal lamps are in such a combined group. The FIGURE represents this for two signal lamps.

What is claimed is:

1. In a display device having a plurality of signal lamps, with each lamp coupled to a signal voltage source through a switch contact, an improved pre-heating and testing arrangement comprising:

a. a test voltage source having a voltage lower than that of the signal voltage;

b. a plurality of first diodes one between each signal lamp and its associated switch;

c. a plurality of second diodes and resistors in series one coupling the junction of each of said lamps and said first diodes to said test voltage;

d. a testing device; and e. a plurality of third diodes each having one of its terminals coupled to a terminal of same polarity of one of said second diodes and all having their other terminal coupled to said testing device, whereby a small current will continually flow through each of said test lamps from said test voltage prewarming said lamps and, should a lamp fail, an appropriate indication will be provided through said third diode to said testing device.

2. Apparatus according to claim 1 wherein said other pole of each of said third diodes are coupled to a common input of said testing device and wherein said testing device comprises means for sequentially and momentarily closing the switch associated with each of said signal lamps.

* * * * *